US005524969A

United States Patent [19]

Harrison et al.

[11] Patent Number: 5,524,969

[45] Date of Patent: Jun. 11, 1996

[54] ANGULARLY ADJUSTABLE BACKREST MOUNTING ASSEMBLY FOR A SEAT

[75] Inventors: Patrick N. Harrison, Aurora; Nenad B. Medjedovic, Downsview, both of Canada

[73] Assignee: Special Health Systems Ltd., Aurora, Canada

[21] Appl. No.: 337,481

[22] Filed: Nov. 8, 1994

[51] Int. Cl.[6] ..... A47C 1/02

[52] U.S. Cl. ..... 297/354.12; 297/358; 297/440.2; 297/374; 297/361.1

[58] Field of Search ..... 297/353, 358, 297/361.1, 374, 440.20, 440.21, 354.12

[56] References Cited

U.S. PATENT DOCUMENTS

| | | | |
|---|---|---|---|
| 4,475,770 | 10/1984 | Persons, II | 297/358 |
| 4,732,423 | 3/1988 | Condon | 297/353 |
| 4,981,325 | 1/1991 | Zarharkow | 297/353 |
| 4,986,564 | 1/1991 | Liu | 297/374 |
| 5,176,706 | 1/1993 | Lee | 297/353 |

FOREIGN PATENT DOCUMENTS

| | | | |
|---|---|---|---|
| 3336349 | 4/1985 | Germany | 297/353 |

*Primary Examiner*—Peter M. Cuomo
*Assistant Examiner*—Anthony D. Barfield
*Attorney, Agent, or Firm*—Rogers & Scott

[57] ABSTRACT

An angularly adjustable backrest mounting assembly for a seat, has an upper transverse member securable at opposite ends to transversely spaced uprights of a seat so as to be angularly movable about a horizontal axis, and a lower transverse member is securable at opposite ends to the transversely spaced uprights below the upper transverse member. An upright member is secured adjacent an upper end thereof to the upper transverse member and adjacent a lower end thereof to the lower transverse member, and a transverse angle retaining member pivotably secured at opposite ends to opposite ends of the upper transverse member is adjustably securable at different heights to the upright member to enable the upper transverse member and the upright member to be retained in the different angular positions. The upright member has attachments to enable a backrest to be secured thereto.

4 Claims, 3 Drawing Sheets

ANGULARLY ADJUSTABLE BACKREST MOUNTING ASSEMBLY FOR A SEAT

This invention relates to angularly adjustable backrest mounting assemblies for seats, namely mounting assemblies to which a backrest of a seat can be secured and which are angularly adjustable about a horizontal axis. Such mounting assemblies are especially useful for wheelchairs but may of course also be used with other kinds of seats.

There is a need for an improved backrest mounting assembly for seats, particularly but not exclusively for wheelchairs, and it is therefor an object of the present invention to provide an improved mounting assembly for this purpose.

According to the invention, an angularly adjustable backrest mounting assembly for a seat comprises an upper transverse member securable at opposite ends to transversely spaced uprights of a seat so as to be angularly movable about a horizontal axis, a lower transverse member securable at opposite ends to the transversely spaced uprights of the seat below the upper transverse member, an upright member secured adjacent an upper end thereof to the upper transverse member and adjacent a lower end thereof to the lower transverse member, a transverse angle retaining member pivotably secured at opposite ends to opposite ends of the upper transverse member and adjustably securable at different heights to the upright member to enable the upper transverse member and the upright member to be retained in different angular positions, the upright member having attachments to enable a backrest to be secured thereto.

The upright member may be tubular and the angle retaining member may be adjustably secured to the upright member by an expandable wedge member slidably movable in the upright member. The upright member may be U-shaped and the upper transverse member may be of V-shape.

Figure 1:
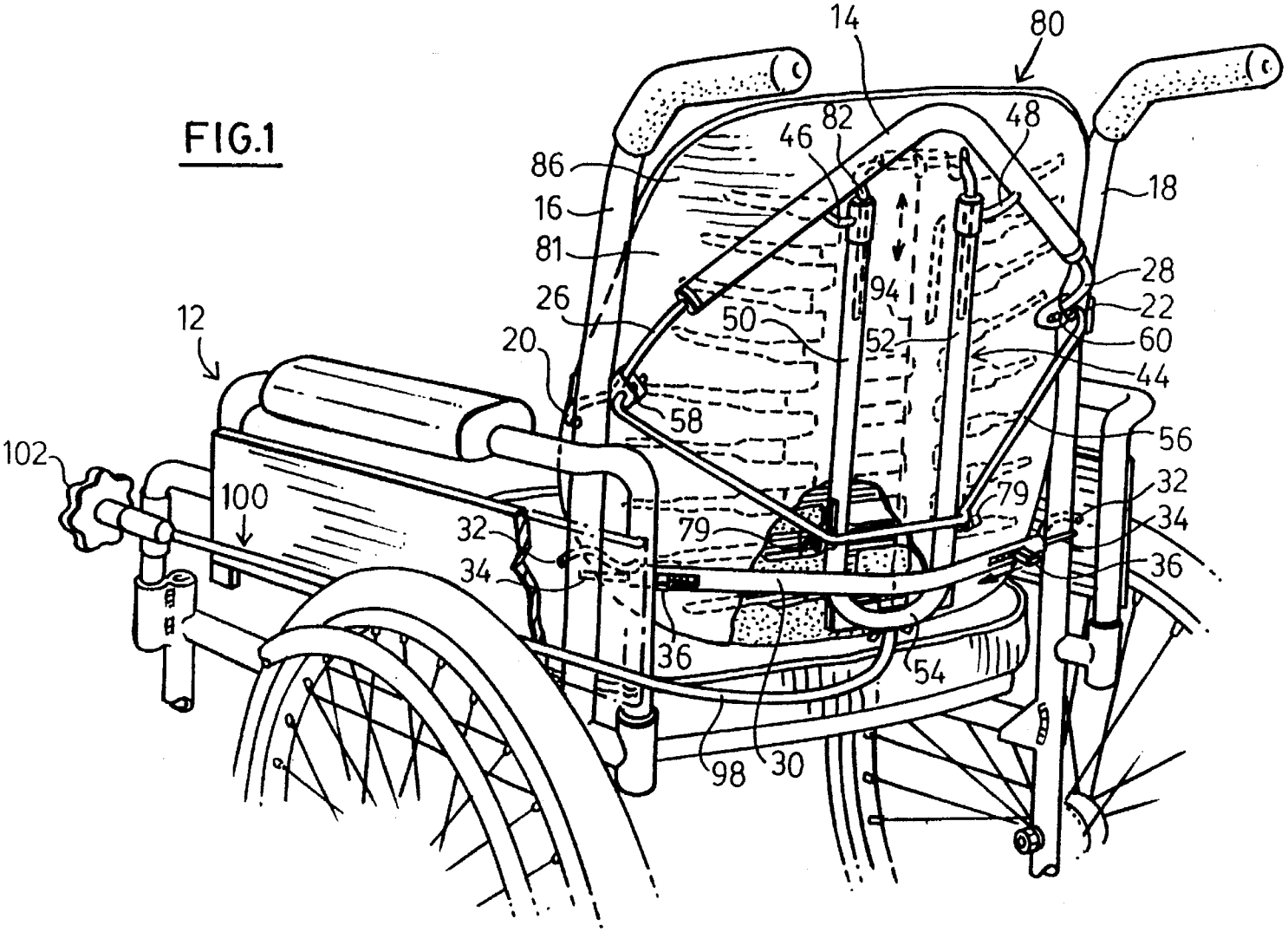
Figure 3:
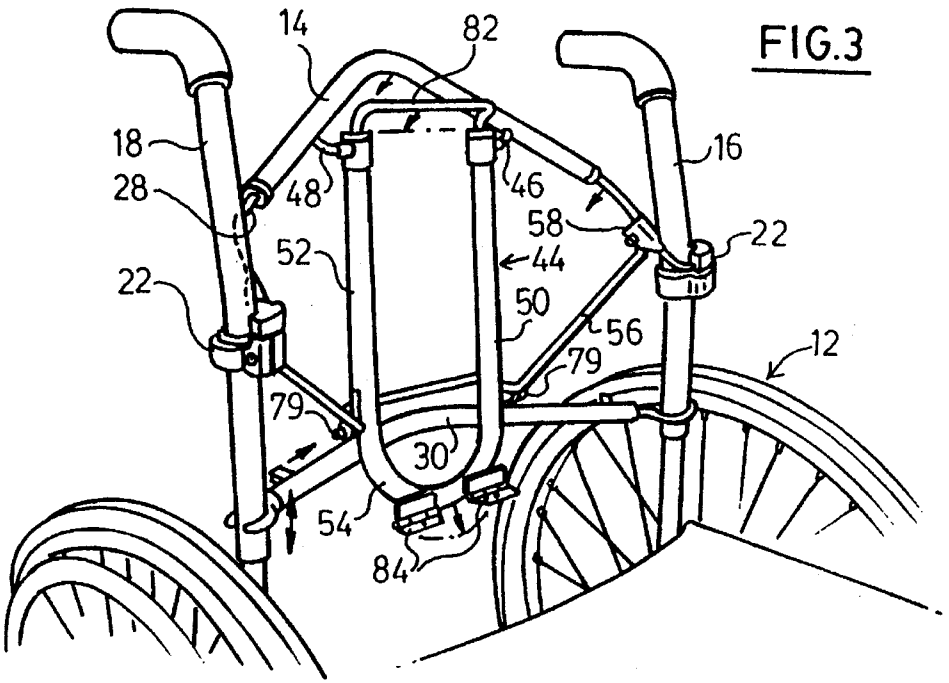
Figure 2:
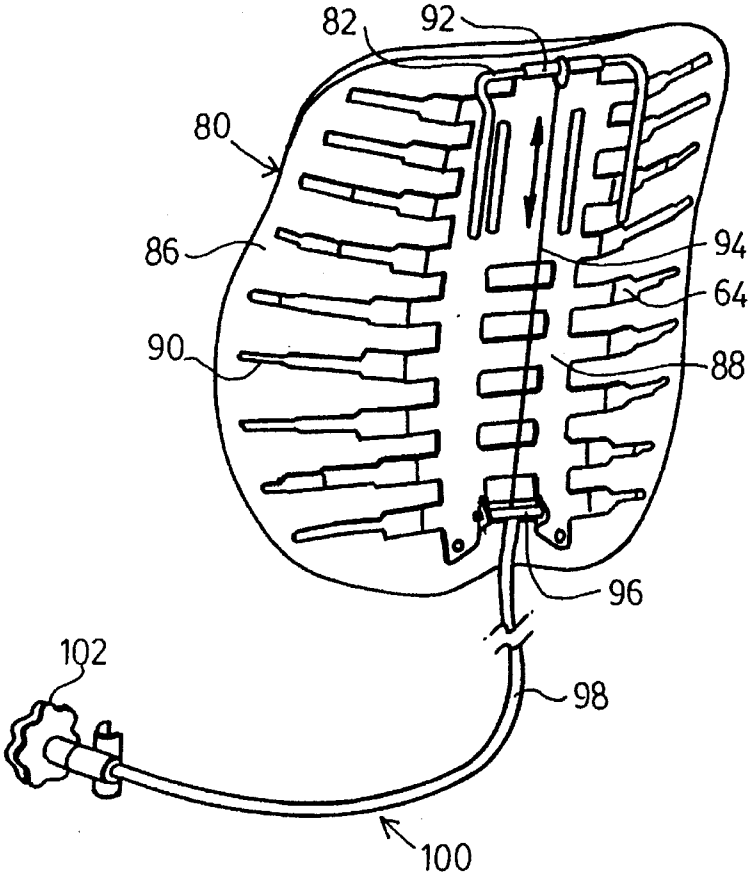
Figure 4:
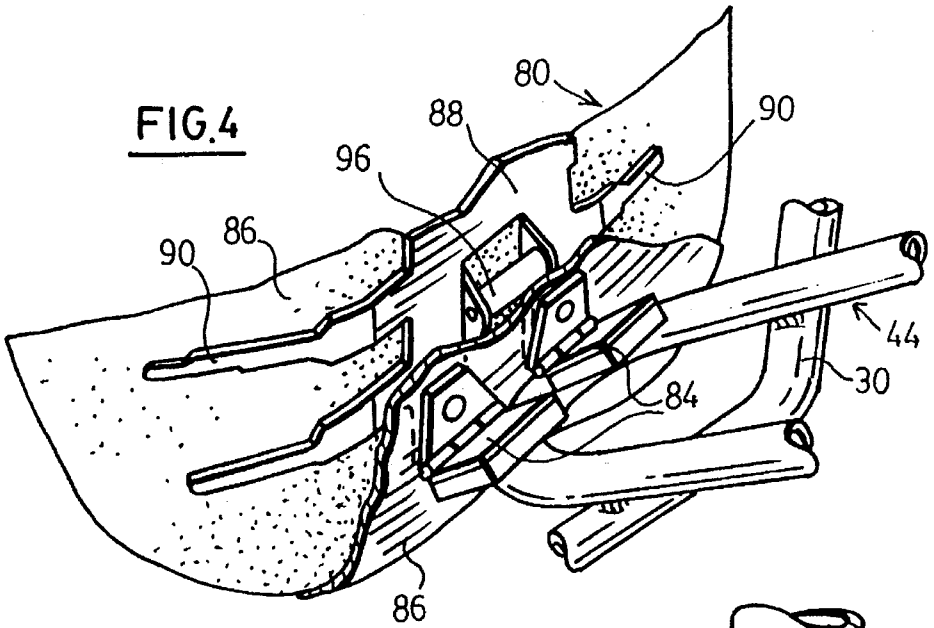
Figure 5:
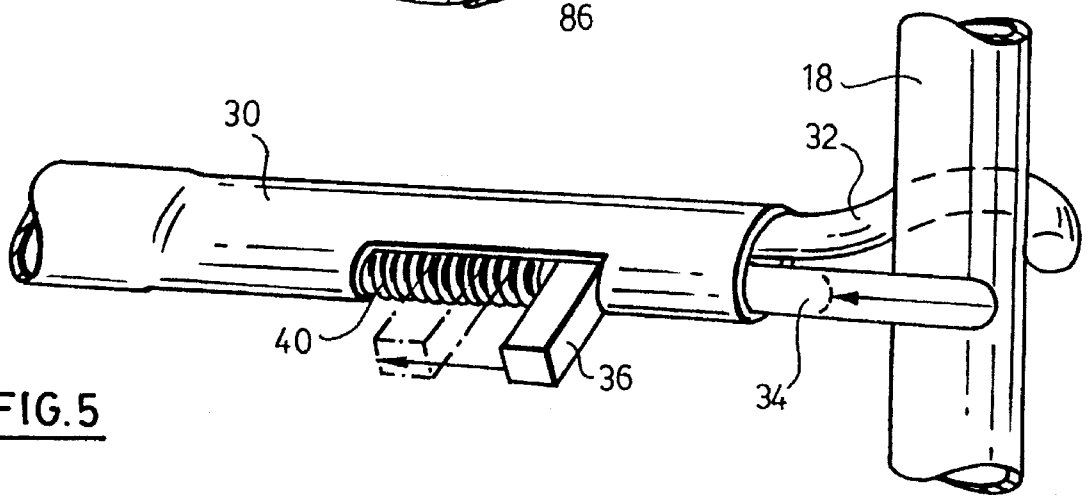
Figure 6:
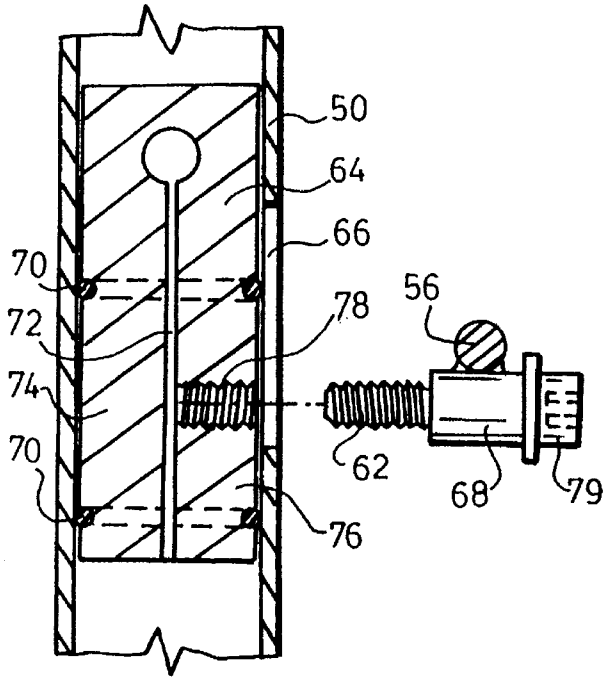

One embodiment of the invention will now be described, by way of example, with reference to the accompanying drawings, of which:

FIG. 1 is a rear perspective view of a wheelchair having an angularly adjustable backrest mounting assembly in accordance with the invention, FIG. 2 is a rear perspective view of the interior of the backrest, FIG. 3 is a front perspective view of the wheelchair without the backrest to show the mounting assembly, FIG. 4 is a perspective view of the backrest attachment at the bottom of the upright member, FIG. 5 is a similar view showing how the lower transverse member is secured to a seat upright, and FIG. 6 is a sectional view showing how angle retaining member is adjustably secured to the upright member.

Referring to the drawings, an angularly adjustable backrest mounting assembly for a wheelchair 12 comprises an upper tubular transverse member 14 of inverted V-shape which is detachably and pivotably secured at opposite ends to the transversely spaced uprights 16, 18 of the wheelchair 12 by removable brackets 20, 22 respectively which enable the upper transverse member 14 to be angularly movable about a horizontal axis. The upper transverse member 14 has a tubular medial portion 24 and rod-like opposite end portions 26, 28 extending therefrom.

A lower tubular transverse member 30 is detachably secured at opposite ends to the transversely spaced uprights 16, 18 below the upper transverse member 14 in a manner which enables the lower transverse member 30 to slide upwardly and downwardly along the uprights 16, 18. Each end of the lower transverse member 30 has a hook portion

32 extending therefrom and operable in cooperation with a retractable rod portion 34 to detachably secure the end of the transverse member 30 to an upright 16 or 18 as shown particularly in FIG. 5. The retractable rod portion 34 is slidably mounted in the end of the transverse member 30 and an actuator 36 secured thereto projects from a slot 38 in the transverse member 30. A helical spring 40 surrounds the rod portion 34 within the transverse member 30 to resiliently urge the rod portion 34 to the extended retaining position. As indicated in FIG. 5, the actuator 36 can be manually operated to retract the rod portion 34 from the retaining position. The spring 40 is seated against an abutment (not shown) within the transverse member 30.

A U-shaped tubular upright member 44 is secured adjacent its upper end to the upper transverse member 14 by connecting rods 46, 48 which extend from the top of a side portion 50 or 52 of the U-shaped upright member 44 to the upper transverse member 14. The connecting rods 46, 48 are rotatable in the side portions 50, 52. The base portion 54 of the U-shaped upright member 44 is secured to the lower transverse member 30.

A transverse angle retaining rod member 56 is pivotably secured at opposite ends by brackets (58, 60) to opposite ends of the upper transverse member 14 and is adjustably securable at different heights to the side portions 50, 52 of the upright member 44 to enable the upper transverse member 14 and the U-shaped upright member 44 to be retained in different angular positions. As shown more particularly in FIG. 6, the angle retaining member 56 is adjustably secured to each side portion 50, 52 of the U-shaped upright member 44 by a bolt 62 and expandable wedge member 64 slidably mounted in the side portion 50 or 52, with the bolt 62 projecting therefrom through a slot 66 and passing through a sleeve 68 secured to the angle retaining member 56.

The expandable wedge member 64 is slidably mounted in the side portion 50 or 52 with direct contact therebetween being avoided by the provision of two rubber O-rings 70 mounted in circumferential grooves in the expandable wedge member 64. The expandable wedge member 64 has a longitudinal slot 7 which extends for most of its length to form two relatively movable clamping portions 74, 76. The bolt 62 is mounted in a threaded bore 78 which passes transversely through one clamping portion 76 so that the bolt 62 can be screwed in (by turning the bolt head 79) to cause the bolt to engage the other clamping portion 74 to force the clamping portions 74, 76 apart and into engagement with the side portion 50 and thereby prevent sliding movement of the expandable wedge member 64.

The U-shaped upright member 44 has upper and lower attachments to enable a backrest 80 to be secured thereto. The upper attachment comprises an inverted U-shaped attachment member 82 whose opposite ends are slidably mounted in the upper ends of the side portions 50, 52 of the U-shaped upright member 44. The lower attachment comprises two hinges 84 secured to the base portion 54 of the U-shaped upright member 44.

The backrest 80 is more specifically described in our application Ser. No. 08/337,481 entitled "Lower Back Support" filed Nov. 8, 1994, the contents of which application are hereby incorporated herein by reference. The backrest 80 has a removable cover 81 which contains a deformable member 86 attached to a deformable spine 88 with transversely extending ribs 90. The upper end of the spine 88 carries a cable anchor 92 through which the upper attachment member 82 extends. An actuator cable 94 extends downwardly from the cable anchor 92 to a sheath 98 which is attached to the lower end of the spine 88 by a sheath anchor 96. The cable 94 and sheath 98 form part of an actuator 100 for controlling the configuration of the back rest 80, the actuator 100 being operated by rotation of a knob 102 as more clearly described in our application referred to above. The lower end of the spine 94 carries two nuts 104 to enable the lower end of the spine 94 to be secured to the hinges 84 on the base portion 54 of the U-shaped upright member 44.

In use, the mounting assembly is secured to the chair uprights 16, 18 and the back rest 80 is secured thereto in the manner described above. By loosening the bolts 62 to enable the expandable wedge members 64 to slide in the side portions 50, 52 of the U-shaped upright member 54 and by then manually gripping and angularly moving the upper transverse member 14, the angle of the U-shaped upright member 44 to the horizontal can be adjusted to a desired setting with such movement causing upward or downward sliding movement of the expandable wedge members 64 in the side portions 50, 52 and upward or downward sliding movement of the lower transverse member 30 along the uprights 16, 18. When the desired angle is obtained, the bolts 62 are tightened to expand the expandable members 64 into engagement with the side portions 50, 52 and prevent further movement.

Advantageously, the tubular portions of the mounting assembly are of aluminum and the rod-like portions are of stainless steel.

The advantages of the invention will be readily apparent to a person skilled in the art from the foregoing description of the preferred embodiment. Other embodiments of the invention will also be readily apparent, the scope of the invention being defined in the appended claims.

We claim:

1. An angular adjustable backrest mounting assembly for a seat, said mounting assembly comprising:

an upper transverse member adapted to be secured at opposite ends to transversely spaced uprights of a seat so as to be angularly movable about a horizontal axis, a lower transverse member adapted to be secured at opposite ends to the transversely spaced uprights below the upper transverse member, an upright member secured adjacent an upper end thereof to the lower transverse member and adjacent a lower end thereof to the lower transverse member, and a transverse angle retaining member having an end pivotally secured to an end of the upper transverse member and an opposite end pivotally secured to an opposite end of the upper transverse member, said angle retaining member having means to adjustably secure the angle retaining member at different heights to the upright member to enable the upper transverse member and the upright member to be retained in the different angular positions, the upright member having attachments for a backrest to be secured thereto.

2. A backrest mounting assembly according to claim 1 wherein the upright member is tubular and the and said means to adjustably secure the angle retaining member to the upright member comprises an expandable wedge member secured to the angle retaining member and mounted for sliding movement in the upright member, said angle retaining member having means to expand the wedge member into non-sliding engagement with the upright member.

3. A bracket mounting assembly according to claim 1 wherein the upright member is U-shaped.

4. A bracket mounting assembly according to claim 1 wherein the upper transverse member is of inverted V-shape.

* * * * *